US007287589B2

(12) United States Patent
Grove et al.

(10) Patent No.: US 7,287,589 B2
(45) Date of Patent: Oct. 30, 2007

(54) WELL TREATMENT SYSTEM AND METHOD

(75) Inventors: Brenden M. Grove, Missouri City, TX (US); Mark C. Duhon, Sugar Land, TX (US); Lawrence A. Behrmann, Houston, TX (US); Claude D. Jones, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 347 days.

(21) Appl. No.: 10/711,785

(22) Filed: Oct. 5, 2004

(65) Prior Publication Data

US 2005/0061506 A1 Mar. 24, 2005

Related U.S. Application Data

(63) Continuation-in-part of application No. 10/667,011, filed on Sep. 19, 2003, now Pat. No. 7,182,138, which is a continuation-in-part of application No. 10/316,614, filed on Dec. 11, 2002, now Pat. No. 6,732,798, which is a continuation-in-part of application No. 09/797,209, filed on Mar. 1, 2001, now Pat. No. 6,598,682.

(60) Provisional application No. 60/509,097, filed on Oct. 6, 2003, provisional application No. 60/186,500, filed on Mar. 2, 2000, provisional application No. 60/187,900, filed on Mar. 8, 2000, provisional application No. 60/252,754, filed on Nov. 22, 2000.

(51) Int. Cl.
*E21B 43/25* (2006.01)

(52) U.S. Cl. ..... 166/297; 166/55.1; 166/162; 166/311; 175/4.54

(58) Field of Classification Search ..... 166/297, 166/311, 55.1, 162; 175/4.54
See application file for complete search history.

(56) References Cited

U.S. PATENT DOCUMENTS

| | | | | |
|---|---|---|---|---|
| 3,163,112 | A * | 12/1964 | Rhea | 102/310 |
| 3,422,760 | A * | 1/1969 | Mohaupt | 102/313 |
| 3,612,189 | A * | 10/1971 | Brooks et al. | 175/4.54 |
| 3,630,282 | A | 12/1971 | Lanmon | |
| 4,905,759 | A * | 3/1990 | Wesson et al. | 166/55 |
| 5,088,557 | A * | 2/1992 | Ricles et al. | 166/297 |
| 5,513,703 | A * | 5/1996 | Mills et al. | 166/55.1 |
| 6,220,355 | B1 | 4/2001 | French | |
| 6,619,176 | B2 * | 9/2003 | Renfro et al. | 86/51 |
| 2002/0020535 | A1 | 2/2002 | Johnson et al. | |
| 2003/0089498 | A1 | 5/2003 | Johnson | |

FOREIGN PATENT DOCUMENTS

| | | |
|---|---|---|
| GB | 785155 | 10/1957 |

* cited by examiner

*Primary Examiner*—Hoang Dang
(74) *Attorney, Agent, or Firm*—Bryan P. Galloway; Kevin B. McGoff; Henry L. Ehrlich

(57) ABSTRACT

A well treatment system of the present invention includes a housing forming a sealed surge chamber, and a surge charge disposed within the sealed surge chamber, wherein the surge charge is adapted upon activation to penetrate the housing and to not penetrate material exterior of the housing. Fluid communication is created between the surge chamber and the wellbore when the housing is penetrated by the surge charge. The penetration permits wellbore fluid to flow quickly into the surge chamber. Fluid flow into the surge chamber may enhance a surge of flow from the formation into the wellbore.

25 Claims, 7 Drawing Sheets

WELL TREATMENT SYSTEM AND METHOD

RELATED APPLICATIONS

This claims the benefit of U.S. Provisional Application Ser. No. 60/509,097 filed on Oct. 6, 2003 and is a continuation-in-part and claims the benefit of U.S. Ser. No. 10/667,011, filed Sep. 19, 2003, now U.S. Pat. No. 7,182,138, which is a continuation-in-part of U.S. Ser. No. 10/316,614, filed Dec. 11, 2002, now U.S. Pat. No. 6,732,798, which is a continuation-in-part of U.S. Ser. No. 09/797,209, filed Mar. 1, 2001, now U.S. Pat. No. 6,598,682, which claims the benefit of U.S. Provisional Application Ser. Nos. 60/186,500, filed Mar. 2, 2000; 60/187,900, filed Mar. 8, 2000; and 60/252,754, filed Nov. 22, 2000. Each of the referenced applications are hereby incorporated by reference.

FIELD OF THE INVENTION

The present invention relates to improving reservoir communication with a wellbore.

BACKGROUND

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One popular method of obtaining clean perforations is underbalanced perforating. The perforation is carried out with a lower wellbore pressure than the formation pressure. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure and superior zonal coverage (pre-conditions for a good fracturing job). Acidizing, another widely used method for removing perforation damage, is not effective (because of diversion) for treating a large number of perforation tunnels.

A need thus continues to exist for a method and apparatus to improve fluid communication with reservoirs in formations of a well.

SUMMARY OF THE INVENTION

In view of the foregoing and other considerations, the present invention relates to treating a well.

Accordingly, a well treatment system and method is provided. A well treatment system of the present invention includes a housing forming a sealed surge chamber, and a surge charge disposed within the sealed surge chamber, wherein the surge charge is adapted upon activation to penetrate the housing and to not penetrate material exterior of the housing. Fluid communication is created between the surge chamber and the wellbore when the housing is penetrated by the surge charge. The penetration permits wellbore fluid to flow quickly into the surge chamber. Fluid flow into the surge chamber may enhance a surge of flow from the formation into the wellbore.

The system may further include perforating charges or be combined with a perforating gun for perforating the surrounding formation and the casing. It may also be desired to provide a well treatment fluid in the wellbore before perforating the formation.

A well treatment method of the present invention includes the steps of disposing a housing having a sealed surge chamber within the wellbore; and detonating a surge charge, disposed in the surge chamber, to penetrate the housing thereby providing fluid communication between the surge chamber and exterior of the housing. The surge charge is adapted to penetrate the housing and not to penetrate the formation, casing or other material exterior of the housing.

The foregoing has outlined the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The foregoing and other features and aspects of the present invention will be best understood with reference to the following detailed description of a specific embodiment of the invention, when read in conjunction with the accompanying drawings, wherein.

DETAILED DESCRIPTION

Figure 1:
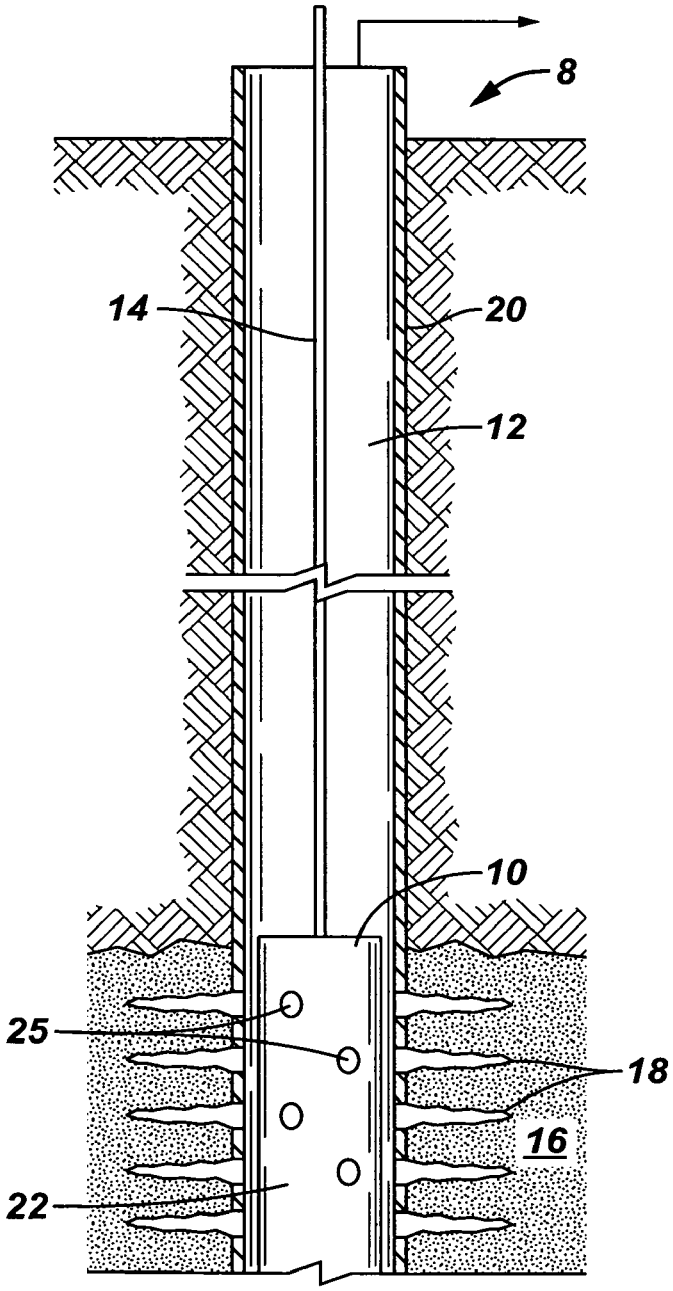
FIG. 1 is an illustration of a well treatment system of the present invention.

Refer now to the drawings wherein depicted elements are not necessarily shown to scale and wherein like or similar elements are designated by the same reference numeral through the several views.

As used herein, the terms "up" and "down"; "upper" and "lower"; and other like terms indicating relative positions to a given point or element are utilized to more clearly describe some elements of the embodiments of the invention. Commonly, these terms relate to a reference point as the surface from which drilling operations are initiated as being the top point and the total depth of the well being the lowest point.

Methods and apparatus are provided to treat perforation damage and to remove debris from tunnels created by perforation into a well formation. Additional methods and apparatus are provided in U.S. Ser. No. 10/667,011 entitled IMPROVING RESERVOIR COMMUNICATION BY CREATING A LOCAL UNDERBALANCE AND USING TREATMENT FLUID, filed on Sep. 19, 2003, U.S. Pat. No. 6,732,798 and U.S. Pat. No. 6,598,682, each of which are hereby incorporated by reference herein.

There are several potential mechanisms of damage to formation productivity and injectivity due to perforation damage. One may be the presence of a layer of low permeability sand grains (grains that are fractured by the shaped charge) after perforation. As the produced fluid from the formation may have to pass through this lower permeability zone, a higher than desired pressure drop may occur resulting in lower productivity. Underbalance perforating is one way of reducing this type of damage. However, in many cases, insufficient underbalance may result in only partial alleviation of the damage. The second major type of damage may arise from loose perforation-generated rock and charge debris that fills the perforation tunnels. Not all the particles may be removed into the wellbore during underbalance perforation, and these in turn may cause declines in productivity and injectivity (for example, during gravel packing, injection, and so forth). Yet another type of damage occurs from partial opening of perforations. Dissimilar grain size distribution can cause some of these perforations to be plugged (due to bridging, at the casing/cement portion of the perforation tunnel), which may lead to loss of productivity and injectivity.

To remedy these types of damage, two forces acting simultaneously may be needed, one to free the particles from forces that hold them in place and another to transport them. The fractured sand grains in the perforation tunnel walls may be held in place by rock cementation, whereas the loose rock and sand particles and charge debris in the tunnel may be held in place by weak electrostatic forces. Sufficient fluid flow velocity is required to transport the particles into the wellbore.

According to various embodiments of the invention, a combination of events are provided to enhance the treatment of damage and removal of debris: (1) application of treatment fluid(s) into tunnels; and/or (2) creation of a local transient low pressure condition (local transient underbalance) in a wellbore interval.

Examples of treatment fluids that are applied include acid, chelant, solvent, surfactant, brine, oil, and so forth. The application of the treatment fluids causes at least one of the following to be performed: (1) remove surface tension within perforation tunnels, (2) reduce viscosity in heavy oil conditions, (3) enhance transport of debris such as sand, (4) clean out residual skin in a perforation tunnel, (5) achieve near-wellbore stimulation, (6) perform dynamic diversion of acid such that the amount of acid injected into each perforation tunnel is substantially the same, and (7) dissolve some minerals. Basically, application of the treatment fluids changes the chemistry of fluids in a target wellbore interval to perform at least one of the above tasks. The application of treatment fluids to perforation tunnels is done in an overbalance condition (wellbore pressure is greater than formation pressure). Application of treatment fluids may be performed by use of an applicator tool, described further below.

A subsequent fluid surge creates the dynamic underbalance condition (wellbore pressure is less than formation pressure) wherein fluid flows from the formation into the wellbore. Following the dynamic underbalance condition, the target wellbore interval is set to any of an underbalance condition, overbalance condition, and balanced condition. Thus, according to some embodiments, a sequence of some combination of overbalance, underbalance, and balanced conditions is generated in the target wellbore interval, such as overbalance-underbalance-overbalance, overbalance-underbalance-underbalance, overbalance-underbalance-balanced, underbalance-overbalance-underbalance, and so forth. This sequence of different pressure conditions occurs within a short period of time, such as in a time period that is less than or equal to about 10 seconds.

The local transient underbalance condition is created by use of a surge chamber containing a relatively low fluid pressure. For example, the surge chamber is a sealed chamber containing a gas or other fluid at a lower pressure than the surrounding wellbore environment. As a result, when the surge chamber is opened, a sudden surge of fluid flows into the lower pressure surge chamber to create the local low pressure condition in a wellbore region in communication with the surge chamber after the surge chamber is opened. Additionally, the wellbore pressure may be reduced by utilizing the surge chamber as a sink.

FIG. 1 is an illustration of a well treatment system of the present invention, generally designated by the numeral 8. Well treatment system 8 includes a surge tool 10. Surge tool 10 is run into the wellbore 12 on a conveyance 14 (e.g., wireline, slickline, coiled tubing, other tubulars, etc.). Other equipment, such as but not limited to, perforating guns, sensors, fluid handling equipment, and chemical application tools, may also be conveyed into the well 12 with surge tool 10. Surge tool 10 is positioned proximate a section of the formation interval 16 that is to be addressed. As shown in FIG. 1, formation 16 and wellbore casing 20 have been perforated as illustrated by tunnels 18. However, it should be noted that it is not necessary for perforations 18 to exist prior to activation of surge tool 10.

Figure 4:
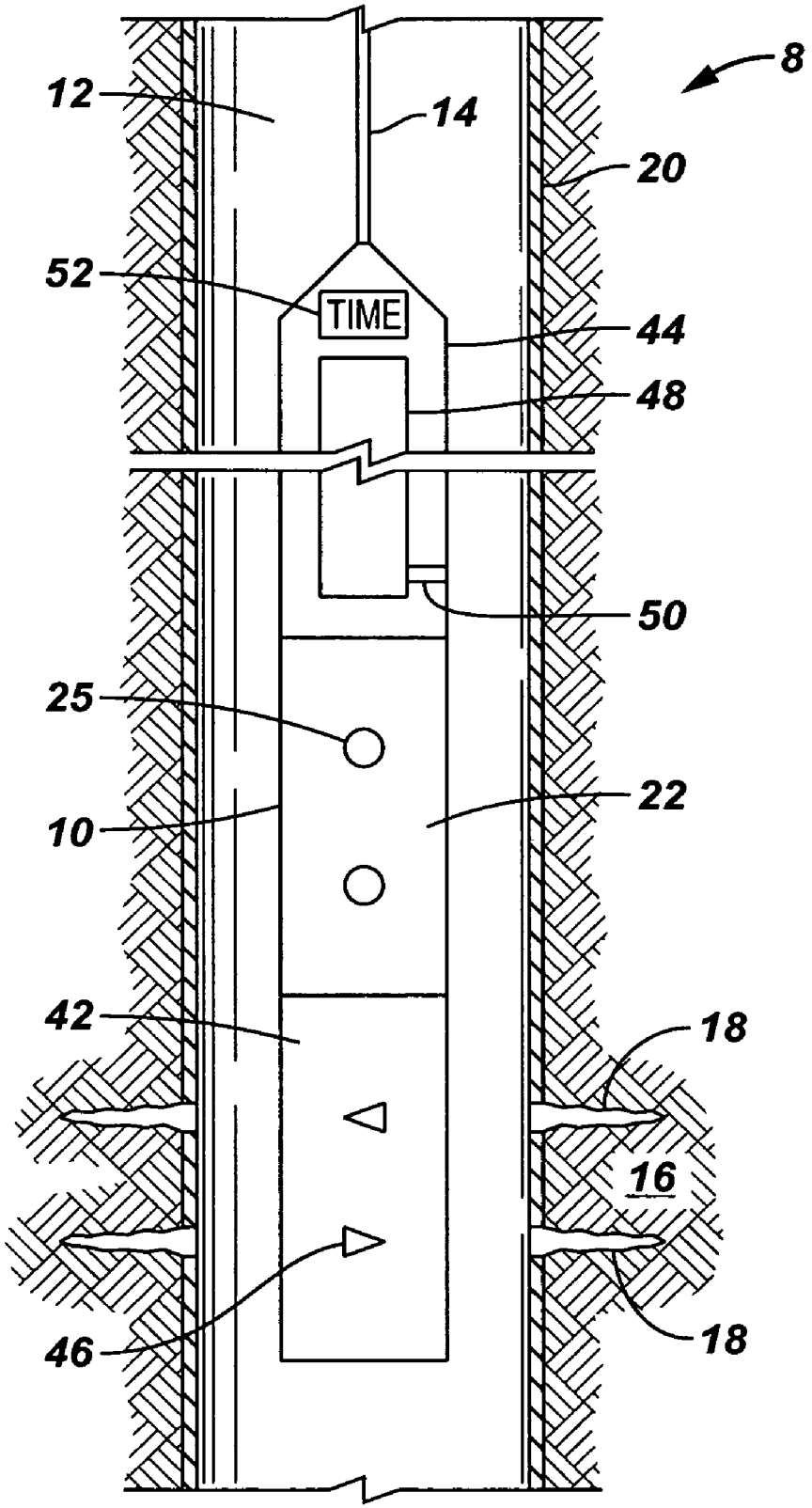
FIG. 4 is an illustration of another well treatment system of the present invention.

Surge tool 10 includes a housing 22 that is sealed from the wellbore 12 environment. It should be recognized that housing 22 may be a part of a perforating gun. Housing 22 may be the housing for perforation gun 42 (FIG. 4). Shaped charges 24, referred to herein as "surge charges," are disposed within housing 22. The surge charges are illustrated in FIG. 1 by the penetrations 25 formed through housing 22 when the surge charges are detonated.

Figure 1A:
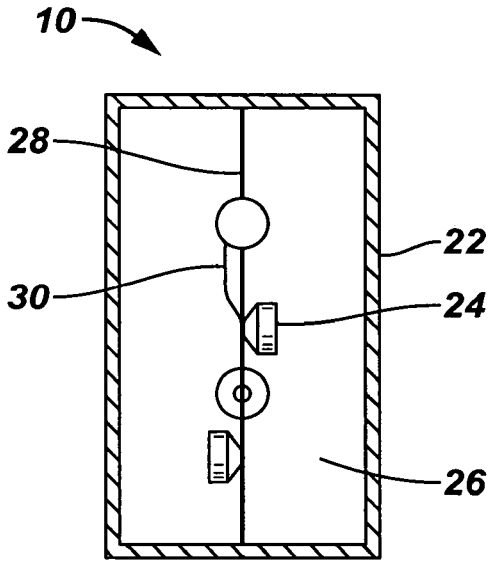
FIG. 1A is a cross-sectional view of the surge tool of FIG. 1

Surge tool 10 is described further with reference to FIG. 1A showing a cross-sectional view of surge tool 10 of FIG. 1. Housing 22 forms a surge chamber 26 that is sealed from the wellbore environment until it is desired to create a pressure change in wellbore 12. One or more surge charges 24 are disposed within surge chamber 26 and may be carried by a loading tube 28. An initiator line 30, such as a detonating cord or an electrical or fiber optic line, is connected to surge charges 24. Surge charges 24 are shaped charges that are adapted to only penetrate housing 22 and not to penetrate, or damage well equipment, such as the wellbore casing, outside of housing 22. The surge charges 24 differ from perforating shaped charges which penetrate the casing and/or the surrounding formation.

Surge chamber 26 has an inner pressure that is lower than an expected pressure in the wellbore 12 in the interval of formation 16 to be treated. Surge chamber 26 may be filled with a fluid, such as, but not limited to air or nitrogen. When surge charges 24 are detonated, housing 22 is penetrated opening surge chamber 26 to wellbore 12. Fluid from the wellbore flows into surge chamber 26 creating a substantially instantaneous underbalance condition.

As the fluid flows from wellbore 12 into surge chamber 26, if it is cooler than the gas inside surge chamber 26 (as is generally the case), then by heat transfer it will cool the gas inside surge chamber 26, thereby dropping its pressure, which further drives continued fluid inflow from wellbore 12 into surge chamber 26. This cooling-induced pressure drop enhances the underbalance condition described above.

The change in the wellbore pressure may be controlled by numerous factors including, the size of housing 22 and surge chamber 26, the initial and relative pressures of the wellbore and the surge chamber, the size of the penetrations through housing 22, the number of penetrations formed through housing 22, the amount and type of explosive used in the surge charges 24, and the shape and construction of the surge charges.

Surge charges 24 are adapted to only penetrate housing 22 and not to perforate or otherwise damage downhole elements such as the well casing as opposed to conventional perforating charges 46 (FIG. 4). Conventional perforating charges have deep concave, typically conical, parabolic, or hemispherical, explosive cavities lined with a high-density, commonly metallic, liners. Surge charges 24 of the present invention have a shallow explosive cavity that may be lined with a very low-density liner or not lined.

Figure 2:
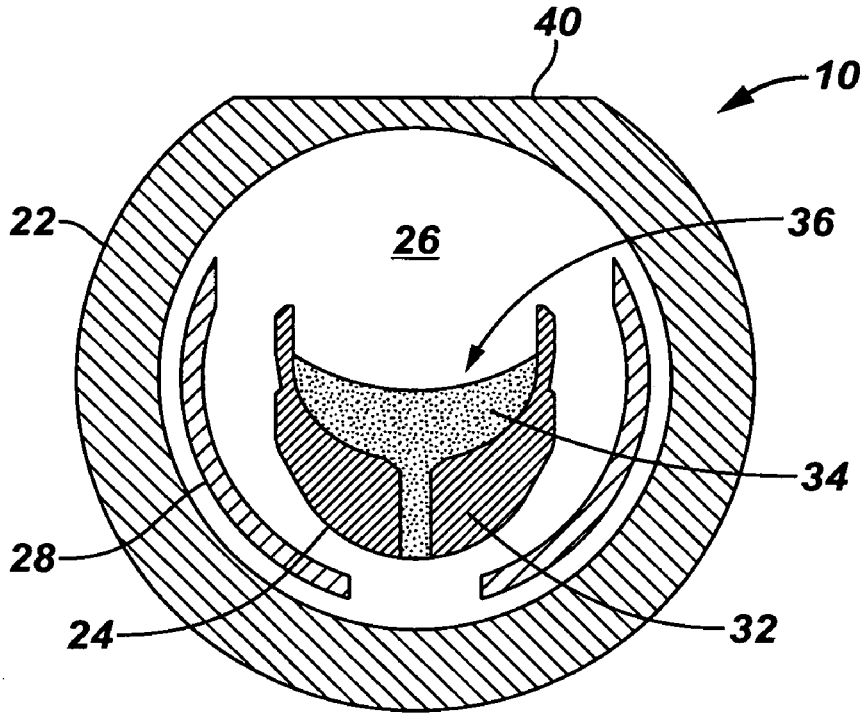
FIG. 2 is a top, cross-sectional view of a surge tool.

FIG. 2 is a top, cross-sectional view of a surge tool 10 of the present invention. FIG. 2 is an example of a linerless shaped charge 24 (surge charge). Surge charge 24 is carried by a loading tube 28 and is disposed within surge chamber 26 of housing 22. Surge charge 24 includes a charge casing 24 and an explosive 34. Explosive 24 forms an explosive cavity 36. Surge charges 24 have a relatively large-radius explosive cavity 36, thus a shallow explosive cavity 36, relative to conventional perforating shaped charges.

Figure 3:
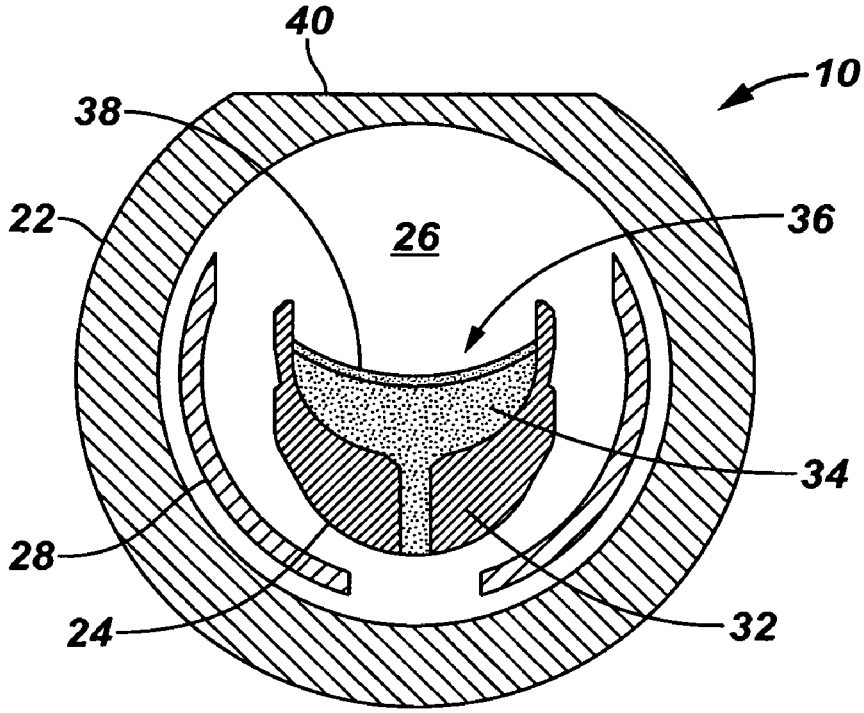
FIG. 3 is a top, cross-sectional view of another surge tool.

FIG. 3 illustrates a surge charge 24 including a liner 38. Liner 38 is applied to explosive cavity 36. Liner 38 may be applied in any manner available such as by pressing, pouring, spraying or painted. Liner 38 is a low-density liner. Liner 38 may be a metallic or non-metallic liner, constructed of a material such as, but not limited to, plastic, salt and sand. Utilization of a liner 38 may permit the use of a smaller amount of explosive 34 when desired.

As illustrated in FIGS. 2 and 3, housing 22 may further include a thinned wall, or scalloped section 40 formed adjacent the explosive cavity 36. Thinned wall section 40 may facilitate penetration of housing 22 when surge charge 24 is detonated and facilitate the amount of explosive 34 that is required.

FIG. 4 is an illustration of an embodiment of well treatment system 8 of the present invention. Well treatment system 8 may include a perforating gun 42 and/or an applicator tool 44, in combination with a surge tool 10 to create a local transient underbalance condition.

Surge tool 10 is described in detail with reference to FIGS. 1 through 3. The surge charges are illustrated in FIG. 4 by penetrations 25 that are created through the wall of housing 22 when the surge charges are detonated.

Perforating gun 42 includes perforating charges 46 that are activatable to create perforation tunnels 18 in formation 16 surrounding a wellbore interval and casing 20. Perforation charges 46 typically have a short-radius explosive cavity, thus a deep explosive cavity, relative to the surge charges 24. Perforating gun 42 can be activated by various mechanisms, such as by a signal communicated over an electrical conductor, a fiber optic line, a hydraulic control line, or other type of conduit.

Well treatment system 8 may further include an applicator tool 44 for applying a treatment fluid (e.g., acid, chelant, solvent, surfactant, brine, oil, enzyme and so forth, or any combination of the above) into the wellbore 12, which in turn flows into the perforation tunnels 18. The treatment fluid applied can be a matrix treatment fluid. Applicator tool 44 may include a pressurized chamber 63 containing the treatment fluid. Upon opening of a port 50, the pressurized fluid in chamber 63 is communicated into the surrounding wellbore interval. Alternatively, applicator tool 44 is in communication with a fluid conduit that extends to the well surface. The treatment fluid is applied down the fluid conduit to applicator tool 44 and through port 50 to fill the surrounding wellbore interval. The fluid conduit for the treatment fluid can be extended through conveyance 14. Alternatively, fluid conduit may run external to conveyance 14.

Figure 5:
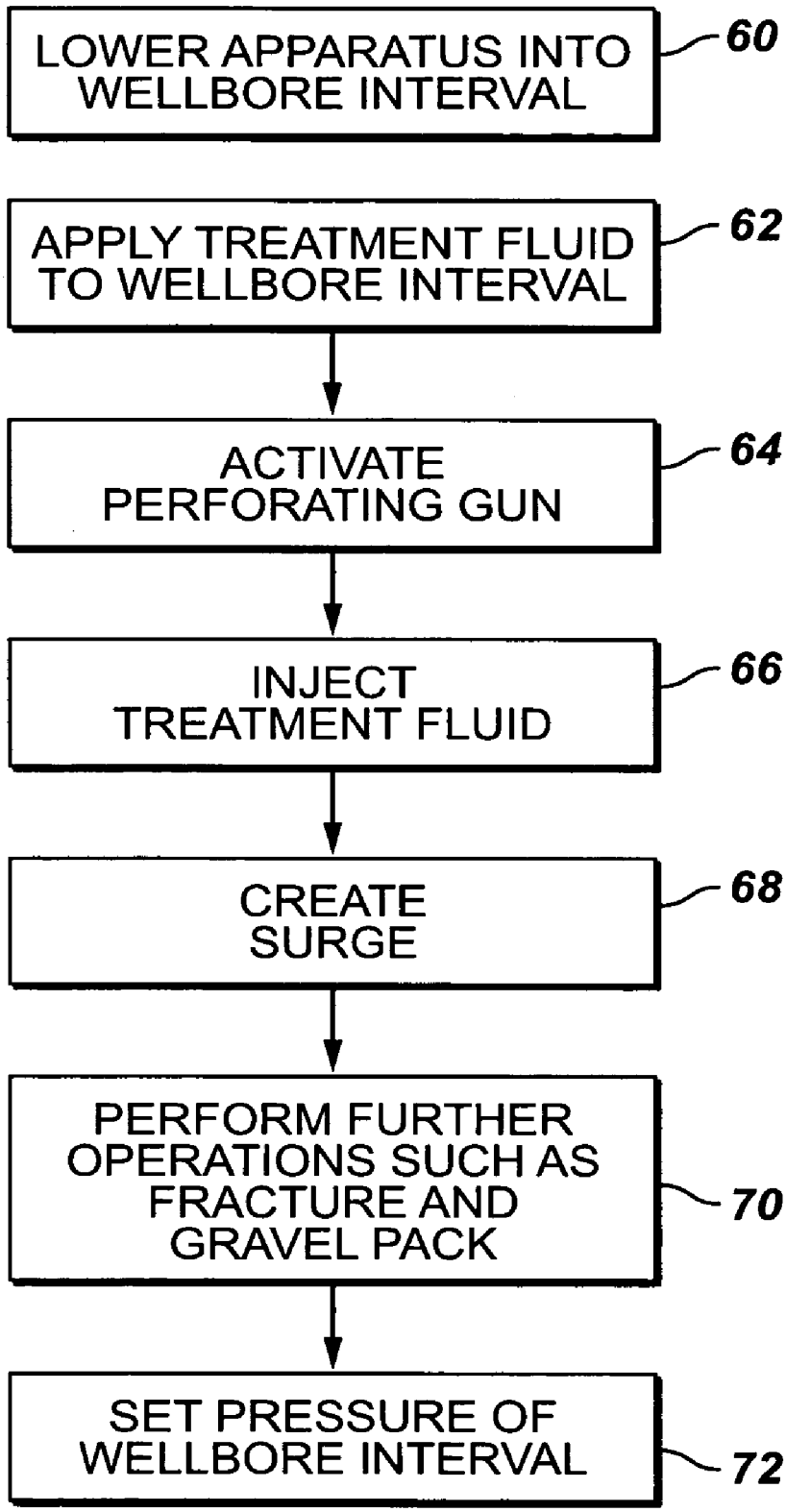
FIG. 5 is a flow diagram of a method according to an embodiment of the present invention.

In operation, as shown in FIG. 5 with reference to FIGS. 1 through 4, well treatment apparatus 8 is lowered at 60 to a wellbore interval. Treatment fluid(s) may then be applied (at 62) by opening port 50 of applicator tool 44. In some cases, the application of the treatment fluid(s) is controlled according to a time release mechanism 52. The rate of dispensing the treatment fluid(s) is selected to achieve optimal performance. In other embodiments, time release mechanism 52 can be omitted. Perforating gun 42 is then activated at 64 to fire shaped charges in the perforating gun to extend perforation tunnels 18 into the surrounding formation 60.

Upon activation of perforating gun 42, a transient overbalance condition is created. The time period of such an overbalance condition can be relatively short (e.g., on the order of milliseconds). This overbalance conditions causes the injection at 66 of treatment fluid into perforation tunnels 18. The timing of application of the treatment fluid(s) 62 can be selected to coincide substantially with the activation of the perforating gun 64 such that the treatment fluid(s) can be injected 66 into the perforation tunnels 18 in the presence of the transient overbalance condition.

To achieve a longer period of overbalance, a tubing conveyed perforating gun can be employed such that pressurized fluid is applied through tubing to create the overbalance condition in the desired interval. An overbalance of thousands of pounds per square inch (psi) can typically be achieved by tubing conveyed perforating guns.

In some cases, such as with carbonate reservoirs, it may be desirable to apply acid into perforation tunnels 18. Conventionally, diversion of such acid occurs such that the acid flows unequally into the various perforation tunnels 18, due to the fact that the acid tends to flow more to paths of least resistance. However, by timing the application substantially simultaneously with the transient overbalance created due to perforating, a more equal distribution of acid into perforation tunnels 18 can be achieved. The more uniform distribution of acid in perforation tunnels 18 is achieved by application of the acid in a relatively short period of time (e.g., milliseconds). This process is referred to a dynamic diversion. The injection of acid into each perforation tunnel 58 provides near-wellbore stimulation, which acts to enhance a subsequent cleanup operation.

Surge tool 10 is activated 68 to create the local transient underbalance condition. This causes a flow of fluid and debris out of perforation tunnels 18 into the wellbore such that cleanup of perforation tunnels 18 can be achieved. Further operations, such as fracturing and/or gravel packing, can then be performed at 70. Prior to, at the same time, or after the further operations 70, the wellbore interval can be set 72 to any one of an overbalance condition, underbalance condition, or balanced condition.

As noted above, a sequence of different pressure conditions are set in the wellbore interval adjacent the formation in which perforation tunnels 18 are created. The pressure conditions include overbalance conditions, underbalance conditions, and balanced conditions. Any sequence of such conditions can be created in the wellbore interval. The examples discussed above refers to first creating an overbalance condition to allow the injection of treatment fluids into perforation tunnels, followed by a transient underbalance condition to clean out the perforation tunnels. After the transient underbalance, another pressure condition is later set in the wellbore interval. The following charts in FIGS. 6-10 illustrate different sequences of pressure conditions that can be set in the wellbore interval.

Figure 6:
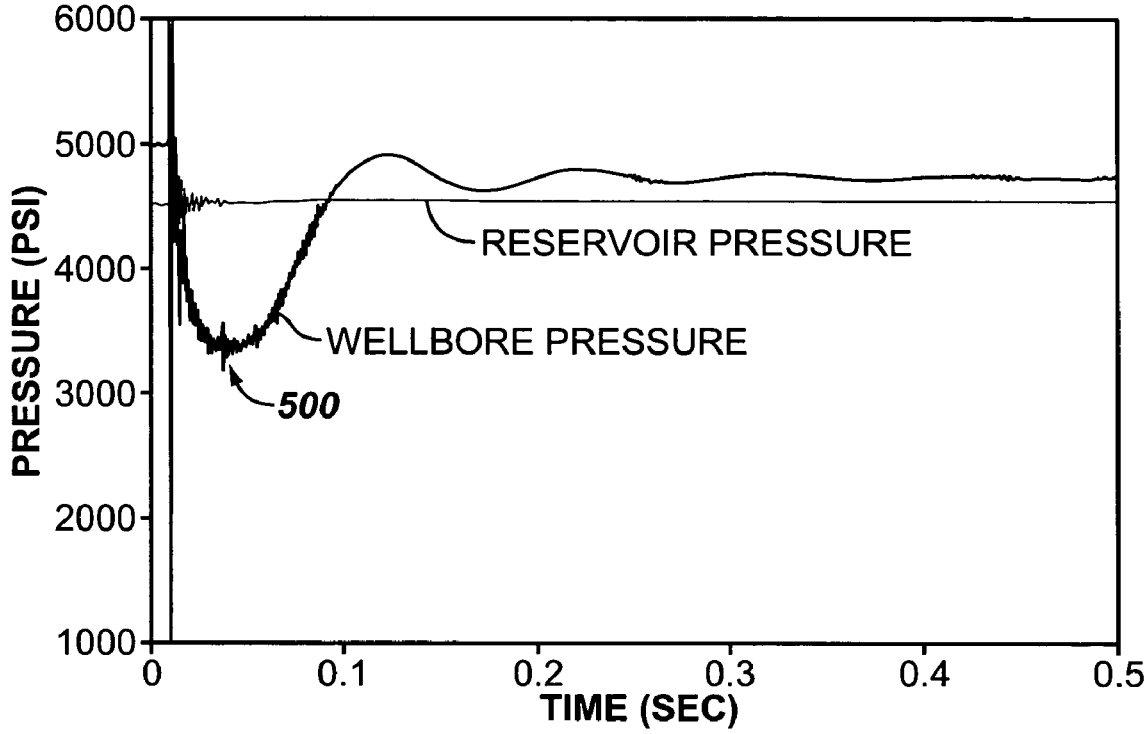
FIG. 6-10 are timing charts of pressure over time pursuant to methods of the present invention.

FIG. 6 shows a chart to illustrate wellbore pressure and reservoir pressure over time (from 0 to 0.5 seconds) beginning at the activation of perforating gun 42 at 64. The target wellbore interval starts with an overbalance condition (where the wellbore pressure is greater than the reservoir pressure). A dynamic underbalance is then created (where the wellbore pressure is less than the reservoir pressure), indicated as 500. As shown in the example of FIG. 6, the dynamic underbalance condition extends a period that is less than 0.1 seconds in duration. Later, after the dynamic underbalance at 500, the wellbore interval is set at an overbalance condition.

Figure 7:
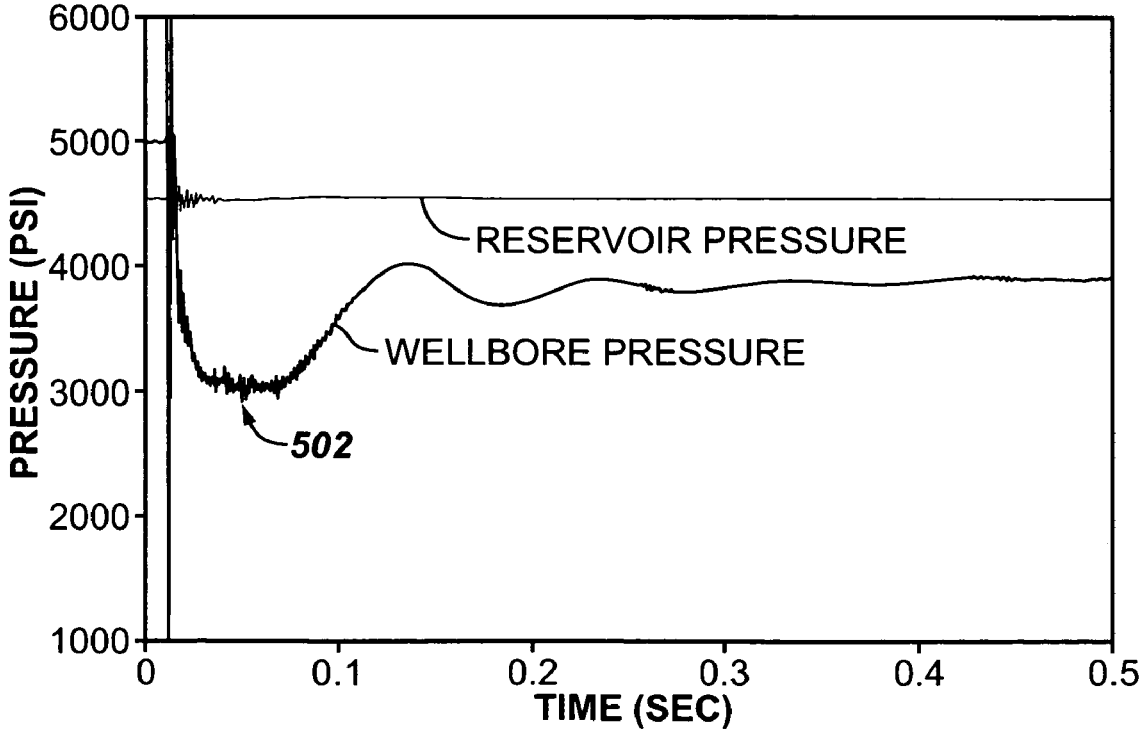

FIG. 7 shows another sequence, in which the wellbore interval starts in the overbalance condition, with a transient underbalance at 502 created shortly after the initial overbalance condition. Later, an underbalance condition is maintained.

Figure 8:
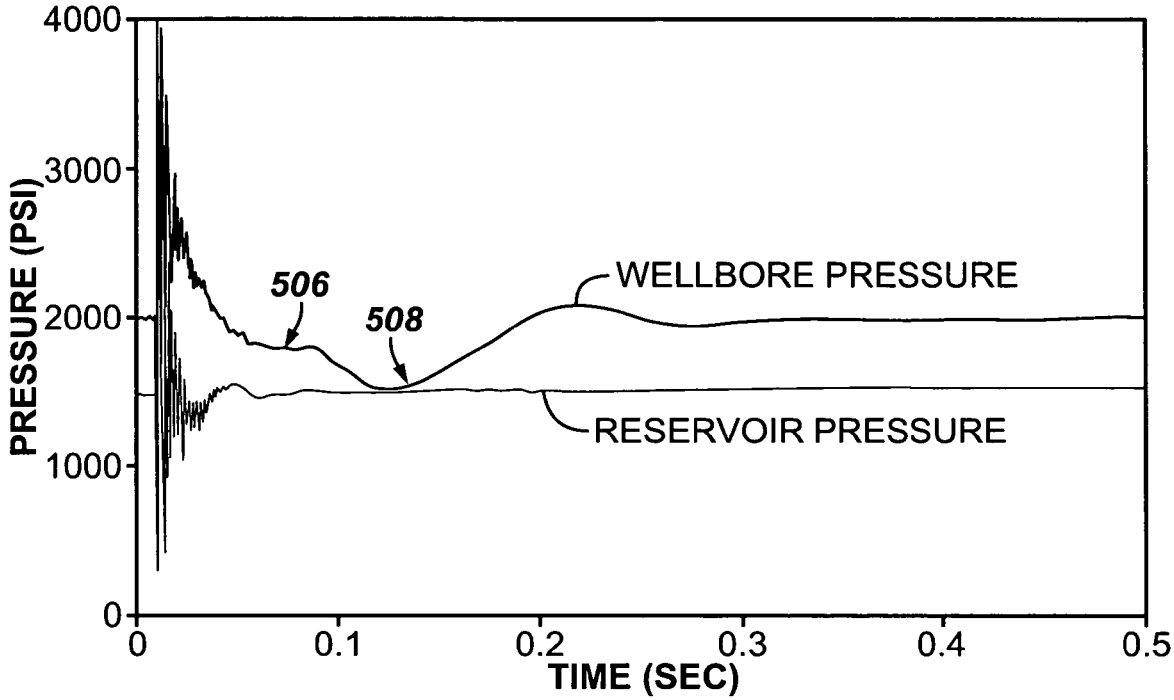

FIG. 8 shows another sequence, in which the wellbore interval starts in an overbalance condition, with a transient pressure dip 506 created in which the wellbore pressure is reduced but stays above the reservoir pressure. Next, the wellbore pressure is reduced further such that it is balanced at 508 with respect to the reservoir pressure. Later, the wellbore pressure is set at a pressure to provide an overbalance condition.

Figure 9:
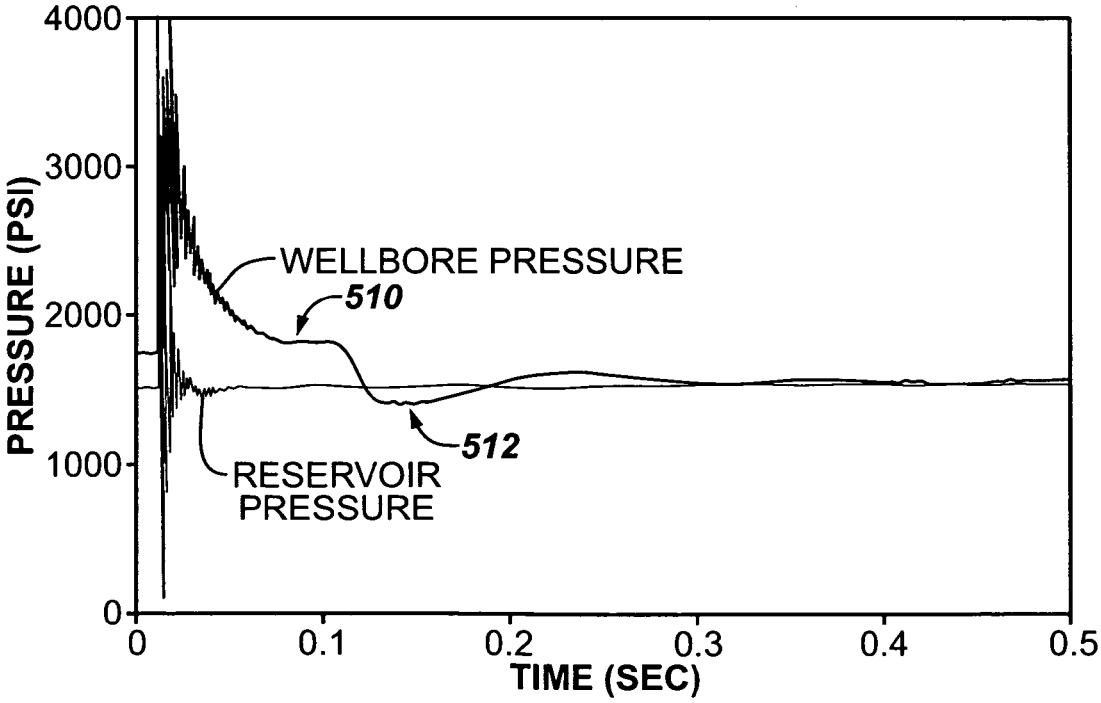

FIG. 9 shows another chart in which the wellbore pressure starts overbalanced, and is followed by a dip in the wellbore pressure to first create a transient condition in which the wellbore pressure remains overbalanced (indicated as 510). Next, another transient condition is created in which the wellbore pressure is dropped further such that an underbalance condition is created (indicated as 512). Later, the wellbore pressure is elevated to provide an overbalance and finally the wellbore pressure and reservoir pressure are balanced.

Figure 10:
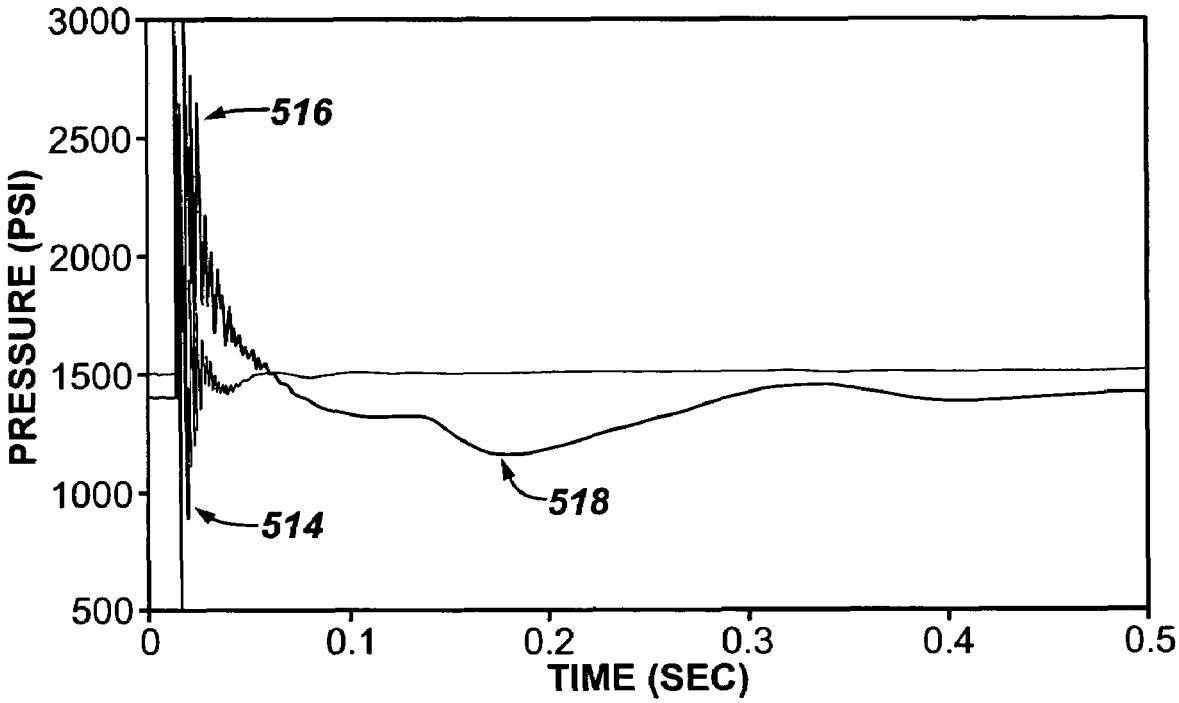

FIG. 10 shows another example sequence, in which the wellbore interval starts underbalanced 514, followed by a transient overbalance (516). After the transient overbalance, a transient underbalance 518 is created. Later, the wellbore interval is kept at the underbalance condition.

The charts in FIGS. 6-10 are illustrative examples, as many other sequences of pressure conditions can be set in the wellbore interval, according to the needs and desires of the well operator.

From the foregoing detailed description of specific embodiments of the invention, it should be apparent that a well treatment system and method that is novel has been disclosed. Although specific embodiments of the invention have been disclosed herein in some detail, this has been done solely for the purposes of describing various features and aspects of the invention, and is not intended to be limiting with respect to the scope of the invention. It is contemplated that various substitutions, alterations, and/or modifications, including but not limited to those implementation variations which may have been suggested herein, may be made to the disclosed embodiments without departing from the spirit and scope of the invention as defined by the appended claims which follow.

What is claimed is:

1. A tool string for achieving a transient underbalance condition in a wellbore, the tool string comprising:

a housing forming a sealed surge chamber;

a surge charge disposed within the sealed surge chamber, wherein the surge charge is adapted upon activation to penetrate the housing and to not penetrate material exterior of the housing; and a chamber carrying a treatment fluid.

2. The tool string of claim 1, wherein a pressure within the surge chamber is less than a pressure exterior of the housing.

3. The tool string of claim 1, wherein the surge charge has a relatively large-radius explosive cavity.

4. The tool string of claim 1, wherein the surge charge has a substantially infinite-radius explosive cavity.

5. The tool string of claim 1, wherein the explosive cavity of the surge charge is lined with a low-density material.

6. The tool string of claim 1, wherein the explosive cavity of the surge charge is unlined.

7. The tool string of claim 1, wherein the housing has a thinned wall section positioned adjacent a explosive cavity of the surge charge.

8. The tool string of claim 1, further including an explosive perforating charge adapted for penetrating a material exterior of the housing.

9. The tool string of claim 8, wherein the perforating charge has an explosive cavity having a radius smaller than the radius of an explosive cavity of the surge charge.

10. The tool string of claim 8, wherein a pressure within the surge chamber is less than the pressure exterior of the housing.

11. The tool string of claim 9, wherein a pressure within the surge chamber is less than a pressure exterior of the housing.

12. The tool string of claim 1, wherein a pressure in the chamber carrying the treatment fluid is greater than a pressure in an area of the wellbore adjacent and external to the chamber carrying the treatment fluid.

13. A tool string for well treatment, the tool string comprising:

a housing forming a sealed surge chamber wherein a pressure within the surge chamber is less than a pressure exterior of the housing when the surge chamber is sealed;

a surge charge disposed within the sealed surge chamber, wherein the surge charge is adapted upon activation to penetrate the housing and to not penetrate material exterior of the housing;

a thin walled section formed in the housing adjacent an explosive cavity of the surge charge;

an explosive perforating charge adapted for penetrating a material exterior of the housing; and a chamber carrying a treatment fluid.

14. The tool string of claim 13, wherein the perforating charge has an explosive cavity having a radius smaller than a radius of the explosive cavity of the surge charge.

15. The tool string of claim 13, wherein the explosive cavity of the surge charge is lined.

16. The tool string of claim 13, wherein the explosive cavity of the surge charge is unlined.

17. The tool string of claim 14, wherein the explosive cavity of the surge charge is unlined.

18. The tool string of claim 13, wherein a pressure in the chamber carrying the treatment fluid is greater than a pressure in an area of the wellbore adjacent and external to the chamber carrying the treatment fluid.

19. A method for treating a well, the method comprising the steps of:

placing a tool string in a wellbore proximate a formation to be treated comprising a housing having a sealed surge chamber, a surge charge disposed within the sealed surge chamber, a perforating charge, and a chamber carrying a treatment fluid;

releasing the treatment fluid into the wellbore;

detonating the perforating charge to create a tunnel in the formation; and detonating the surge charge to penetrate the housing thereby providing fluid communication between the wellbore and the surge chamber.

20. The method of claim 19, wherein the sealed surge chamber has a lower pressure than a wellbore pressure proximate the housing.

21. The method of claim 19, wherein the treatment fluid is released into the wellbore before detonating the perforating charge.

22. The method of claim 20, wherein the treatment fluid is released into the wellbore before detonating the perforating charge.

23. The method of claim 19, wherein the surge charge has an explosive cavity with a radius relatively larger than the radius of the perforating charge explosive cavity.

24. The method of claim 20, wherein the surge charge has a substantially infinite-radius explosive charge cavity.

25. The method of claim 19, wherein a pressure in the chamber carrying the treatment fluid is greater than a pressure in an area of the wellbore adjacent and external to the chamber carrying the treatment fluid.

* * * * *